US011452925B2

(12) United States Patent
Shiga

(10) Patent No.: US 11,452,925 B2
(45) Date of Patent: Sep. 27, 2022

(54) YOGA MAT CARRIERS

(71) Applicant: Emi Shiga, Bellevue, WA (US)

(72) Inventor: Emi Shiga, Bellevue, WA (US)

( * ) Notice: Subject to any disclaimer, the term of this patent is extended or adjusted under 35 U.S.C. 154(b) by 545 days.

(21) Appl. No.: 16/593,384

(22) Filed: Oct. 4, 2019

(65) Prior Publication Data

US 2020/0230485 A1 Jul. 23, 2020

Related U.S. Application Data

(60) Provisional application No. 62/794,901, filed on Jan. 21, 2019.

(51) Int. Cl.

| | |
|---|---|
| ***A63B 71/00*** | (2006.01) |
| ***A45F 3/02*** | (2006.01) |
| ***A45F 3/14*** | (2006.01) |
| ***A63B 21/00*** | (2006.01) |

(52) U.S. Cl.

CPC ..... *A63B 71/0036* (2013.01); *A45F 3/02* (2013.01); *A63B 21/4037* (2015.10); *A45F 2003/142* (2013.01)

(58) Field of Classification Search

CPC ..... A63B 71/0036; A63B 21/4037; A63B 2209/00; A63B 2225/09; A45F 3/02; A45F 2003/142; A45C 13/30

See application file for complete search history.

(56) References Cited

U.S. PATENT DOCUMENTS

| | | | | |
|---|---|---|---|---|
| 4,967,986 A | | 11/1990 | Schildkraut | |
| 5,344,056 A | | 9/1994 | Chailoner et al. | |
| 6,491,196 | B1 * | 12/2002 | Coler | A45F 3/14 224/648 |
| 6,640,359 | B1 * | 11/2003 | Alane | A47G 27/0237 5/420 |
| 6,751,816 | B1 * | 6/2004 | Wechsler | A47G 9/062 383/4 |
| 7,976,088 | B1 | 7/2011 | Diciolla | |
| 8,454,484 | B2 * | 6/2013 | Keen | A63B 21/02 24/298 |

(Continued)

FOREIGN PATENT DOCUMENTS

| | | |
|---|---|---|
| CN | 207980256 U | 10/2018 |
| WO | 2017119000 A1 | 7/2017 |

OTHER PUBLICATIONS

International Search Report and Written Opinion in International Application No. PCT/US2019/054766, dated Dec. 11, 2019, 9 pages.

*Primary Examiner* — Nyca T Nguyen
(74) *Attorney, Agent, or Firm* — Perkins Coie LLP

(57) ABSTRACT

Carriers for securely carrying yoga mats are disclosed. In one embodiment, for example, a carrier comprises a planar portion and a shoulder strap portion coupled to the planar portion. The planar portion includes a first surface, a second surface opposite the first surface, and a securing strap coupled to the first surface. In operation, the first surface of the planar portion is positionable to interface with a yoga mat before the planar portion is rolled up with the yoga mat. The yoga mat can continue to be rolled up until the planar portion wraps around an exterior surface of the rolled-up mat. The shoulder strap is then fed through a securing strap on the carrier to secure the carrier to the yoga mat. The shoulder strap can then be used by a yoga practitioner to carry the yoga mat.

18 Claims, 8 Drawing Sheets

(56) References Cited

U.S. PATENT DOCUMENTS

| | | | | |
|---|---|---|---|---|
| 10,953,271 | B2 * | 3/2021 | Marchetti | A63B 21/4037 |
| 2005/0192158 | A1 * | 9/2005 | Edwards | A63B 6/00 482/148 |
| 2005/0239604 | A1 * | 10/2005 | Denham | A63B 21/4037 482/148 |
| 2006/0060624 | A1 | 3/2006 | Duncan et al. | |
| 2008/0116239 | A1 | 5/2008 | Lu | |
| 2008/0283566 | A1 | 11/2008 | Chace | |
| 2009/0276957 | A1 * | 11/2009 | Boitet-Ball | B62B 1/266 224/264 |
| 2011/0131723 | A1 | 6/2011 | Andrews | |
| 2012/0227181 | A1 * | 9/2012 | Cintas | A47G 27/0237 112/475.08 |
| 2014/0069970 | A1 * | 3/2014 | Thomas, Jr. | A45F 3/14 224/257 |
| 2015/0231438 | A1 * | 8/2015 | Romero Urias | A63B 21/00185 482/131 |
| 2018/0250542 | A1 * | 9/2018 | Schwandt | A63B 21/0023 |
| 2018/0353801 | A1 * | 12/2018 | Ruse | A47K 10/02 |
| 2019/0038953 | A1 * | 2/2019 | Bell | H05B 47/155 |
| 2019/0126121 | A1 * | 5/2019 | Ramaswamy | A63B 71/0036 |
| 2019/0134484 | A1 * | 5/2019 | Bova | A63B 71/0036 |
| 2020/0108289 | A1 * | 4/2020 | Marchetti | A63B 21/4037 |

* cited by examiner

YOGA MAT CARRIERS

CROSS-REFERENCE TO RELATED APPLICATION(S)

The present application claims the benefit of U.S. Provisional Patent Application No. 62/794,901 filed Jan. 21, 2019, entitled QUICK ROLL-UP YOGA MAT CARRIER, the entirety of which is incorporated herein by reference.

TECHNICAL FIELD

The present technology relates to yoga mat carriers and methods for using such devices.

BACKGROUND

Many individuals enjoy practicing yoga to help improve their flexibility and strength and/or to help reduce stress/anxiety. Typically, yoga is either practiced at the individual's home or in a yoga studio under the supervision and direction of an instructor. In western societies, the modern form of yoga includes a series of stretching poses that are achieved through a sequence of movements. Yoga mats and other equipment (e.g., blocks, straps, blankets, etc.) are often used by yoga practitioners to aid in achieving specific poses. Yoga mats are typically formed from a textured rubber material that provides cushioning and a sticky/non-slip surface for the yoga practitioner to use to improve the balance and stability of the practitioner and to provide protection to their exposed hands and feet. Most yoga practitioners choose to use their own mats when practicing yoga and many yoga studios even require that everyone provide their own mat. Yoga mats, which are typically 24 inches wide and 68 inches (or more) long and can weigh between 2 and 7 pounds, can be rolled into a cylindrical shape when not in use to allow the practitioners to more easily carry and transport the yoga mat. Yoga mat carriers, such as bags and carriers that include straps configured to extend around the rolled-up yoga mat, are commonly used by practitioners to carry and transport their personal yoga mats. However, it is often difficult and time-consuming to secure a yoga mat in conventional yoga mat carriers.

DETAILED DESCRIPTION

The following disclosure is generally directed to yoga mat carriers and methods for using such devices. In one embodiment, for example, a carrier for securely carrying a yoga mat comprises a shoulder strap portion and a planar portion coupled to the shoulder strap portion. The planar portion has a first surface and a second surface opposite the first surface. A securing strap is coupled to the first surface. In operation, the first surface is positionable to interface with the yoga mat before the planar portion is rolled up with the yoga mat and, after the planar portion is rolled up with the yoga mat, the securing strap is sized and positioned to admit at least a part of the shoulder strap portion through the strap.

Certain details are set forth in the following description and in FIGS. 1-13C to provide a thorough understanding of various embodiments of the technology. Well-known structures, systems and methods often associated with beverage containers and related apparatuses, however, have not been shown or described in detail below to avoid unnecessarily obscuring the description of the various embodiments of the present technology. Any dimensions, angles, and other specifications shown in the Figures are merely illustrative of particular embodiments of the technology. Accordingly, other embodiments of the technology can have other dimensions, angles, and specifications without departing from the spirit or scope of the present disclosure. In addition, those of ordinary skill in the relevant art will understand that additional embodiments of the technology may be practiced without several of the details described below.

Figure 1A:
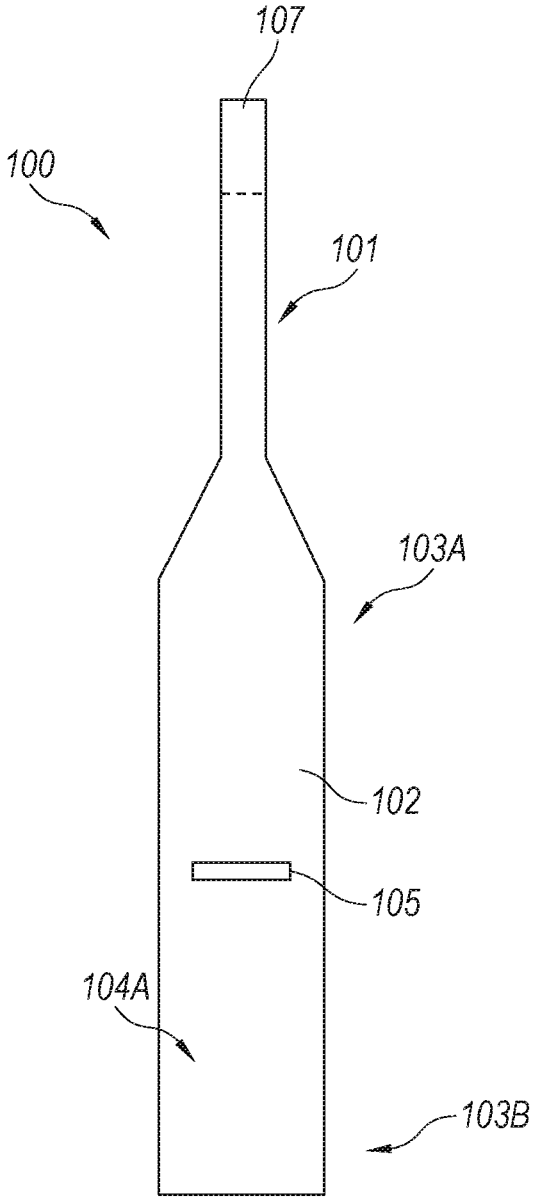
FIGS. 1A and 1B are plan views of a yoga mat carrier configured in accordance with embodiments of the present technology.
Figure 1B:
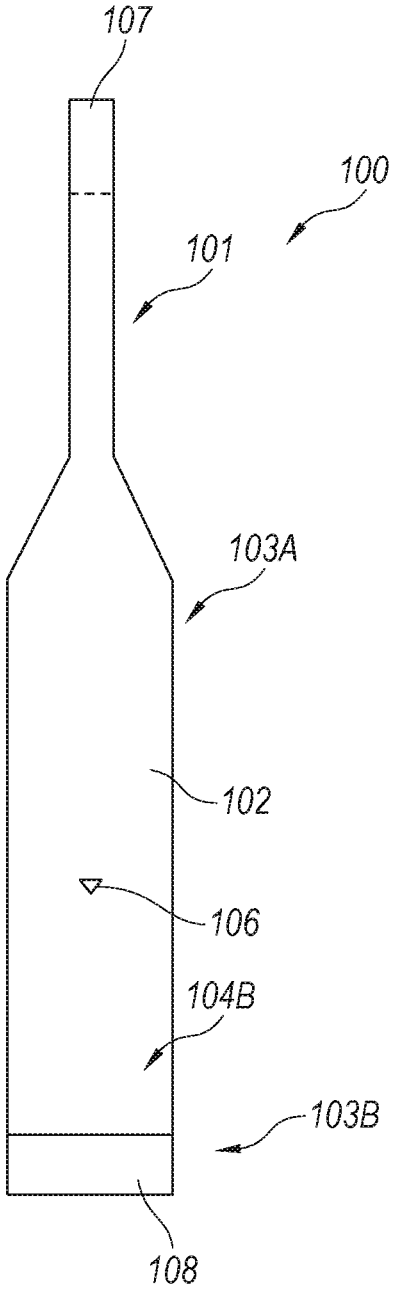

FIG. 1A is a top plan view of a carrier 100 that can be used to securely carry a yoga mat and FIG. 1B is bottom plan view of the carrier 100. The carrier 100 includes a shoulder strap portion 101 and a planar portion 102 coupled to the shoulder strap portion 101. To increase the strength and comfortability of the shoulder strap portion 101, in some embodiments the shoulder strap portion 101 can include a segment of reinforcing material 107 (e.g., neoprene fabric) stitched to the shoulder strap portion 101. In some embodiments, the length of the shoulder strap portion 101 can be adjustable. The planar portion 102 includes opposing first and second end portions 103A and 103B. In the illustrated embodiment, the shoulder strap portion 101 is coupled to the planar portion 102 at the first end portion 103A. A pocket 108 is formed at the second end portion 103B of the planar portion and can be used to store the carrier 100 when the carrier 100 is not in use.

The shoulder strap portion 101 and the planar portion 102 are preferably formed from a lightweight, soft, and flexible material that is capable of bending and folding without being damaged. In some embodiments, the shoulder strap portion 101 and the planar portion 102 are formed from a lightweight polymer material such as nylon. In other embodiments, the shoulder strap portion 101 and the planar portion 102 can be formed from a different polymer material, such as polypropylene or polyester, or a natural material, such as woven cotton. Further, the shoulder strap portion 101 and the planar portion 102 each can be formed from different materials or from the same material.

The carrier 100 also includes opposing first and second sides or surfaces 104A and 104B. To help secure the carrier 100 to a yoga mat, the carrier 100 can include a securing strap or securing loop 105 attached to the first side 104A of the planar portion 102. Specifically, the securing strap 105 can be positioned between the first and second end portions 103A and 103B and near or at a midpoint of the planar portion 102. As will be discussed in greater detail below, the securing strap 105 is sized and positioned to allow the shoulder strap portion 101 to pass through the securing strap to secure the carrier 100 to a rolled-up yoga mat (not shown). In some embodiments, the securing strap 105 can be formed from the same material as the shoulder strap portion 101 and the planar portion 102. Specifically, the securing strap 105 can be formed from a strip or band of nylon material stitched to the planar portion 102 to form a strap. In other embodiments, however, the securing strap 105 can be formed from two adjacent slits formed through the planar portion 102. In still other embodiments, the securing strap 105 can be formed from a different material (e.g., a webbing material) from the shoulder strap portion 101 and the planar portion 102.

The carrier 100 can also include an alignment mark 106 formed on the second side 104B of the planar portion 102. When securing the carrier 100 to a yoga mat, the alignment mark 106 can be used as a guide to help a yoga practitioner properly align the carrier 100 with the edge of the yoga mat, which helps to ensure that the carrier 100 remains securely coupled to the yoga mat. Similar to the securing strap 105, the alignment mark 106 can be positioned between the first and second end portions 103A and 103B and near the midpoint of the planar portion 102. However, the alignment mark 106 is preferably positioned closer to the second end portion 103B than the securing strap 105 is. In the illustrated embodiment, the alignment mark 106 has a generally triangular shape. However, this is merely an example. In other embodiments, the alignment mark 106 can be rectangular, circular, linear, or any other suitable shape. In some embodiments, the alignment mark 106 can be printed onto the second side 104B of the planar portion 102. In other embodiments, however, the alignment mark 106 can be formed from a piece of fabric (e.g., a woven material, felt, etc.) stitched to the planar portion 102. In still further embodiments, the alignment mark 106 may be composed of a different suitable material.

Figure 2:
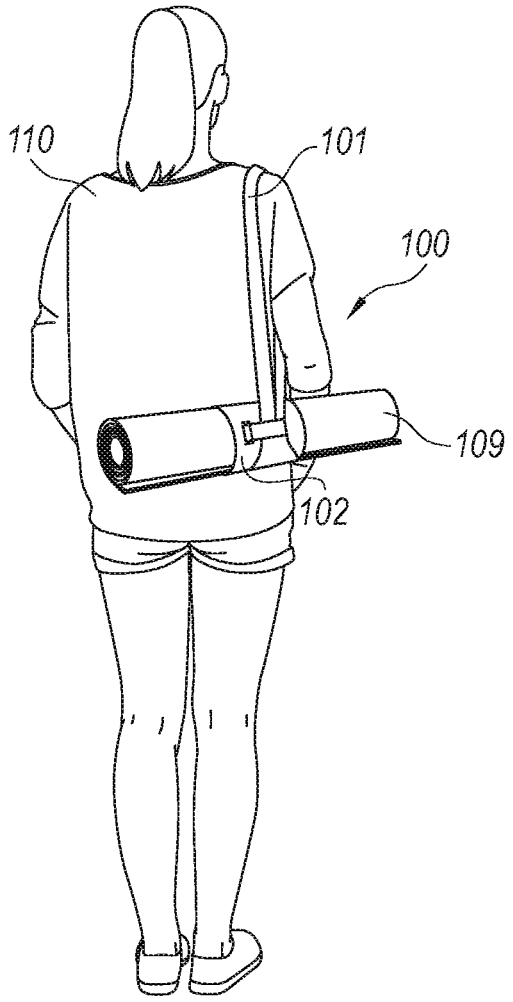
FIG. 2 is an isometric view of a person carrying a yoga mat using the carrier shown in FIGS. 1A and 1B.

FIG. 2 is an isometric view of a person 110 using the carrier 100 to carry a yoga mat 109. The planar portion 102 is configured to wrap around the yoga mat 109, which is rolled-up into a generally cylindrical configuration, while the person 110 uses the shoulder strap portion 101 to secure the carrier 100 and yoga mat 109 over their shoulder. In this configuration, the carrier 100 can secure the yoga mat 109 in a generally horizontal orientation relative to a local surface (e.g. the floor or ground on which the person 110 is standing or walking) and the yoga mat 109 can be positioned adjacent to the person's lower back.

Figure 3:
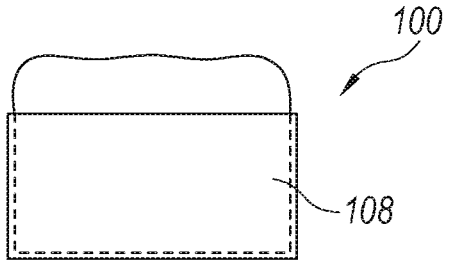
FIG. 3 is a plan view of the yoga mat carrier shown in FIGS. 1A and 1B in a folded configuration.

FIG. 3 is a plan view of the carrier 100 when the carrier is stuffed into the pocket 108 for storage. When the carrier 100 is not being used to carry the yoga mat 109, the carrier 100 can be compactly stored out of the way by folding and/or stuffing the shoulder strap portion 101 and the planar portion 102 into the pocket 108. The pocket 108 can be formed from a segment of stretchy and elastic material that is stitched to the second end portion 103B. In some embodiments, the pocket 108 is formed from a woven cotton material. In this way, the pocket 108 can stretch to allow the rest of the carrier 100 to easily fit within the pocket 108. In other embodiments, however, the pocket 108 may be composed of other suitable materials.

Figure 4:
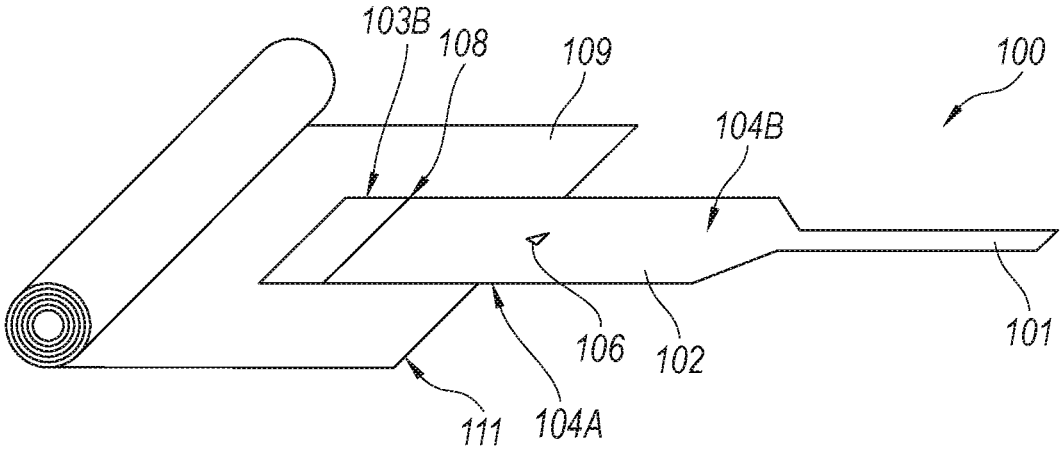
FIGS. 4-7 illustrate the process by which the yoga mat carrier shown in FIGS. 1A and 1B can be used to secure a yoga mat.

FIGS. 4-7 illustrate the process by which the carrier 100 can be secured to the yoga mat 109. The yoga mat 109, for example, is a conventional yoga mat having a rectangular shape and is formed from a textured rubber material that is soft and flexible, allowing the yoga mat 109 to be easily folded and rolled. Accordingly, the yoga mat 109 can be rolled into a generally cylindrical shape when not in use, which allows the yoga mat 109 to be more easily manipulated and handled. As shown in FIG. 4, the carrier 100 can first be positioned on the yoga mat 109 such that the second end portion 103B overlaps with the yoga mat 109 while the first end portion 103A and the shoulder strap portion 101 extend beyond an edge 111 of the yoga mat 109 and therefore do not overlap with the yoga mat 109. Further, the carrier 100 is preferably oriented such that the second side 104B faces away from the yoga mat 109 while the first side 104A faces toward the yoga mat 109. The alignment mark 106 can be used to align the carrier 100 with the edge 111 of the yoga mat 109 to help ensure that the carrier 100 is properly positioned. Specifically, the carrier 100 can be positioned such that a tip of the alignment mark 106 points to and is aligned with or directly adjacent to the edge 111 of the yoga mat 109.

Figure 5:
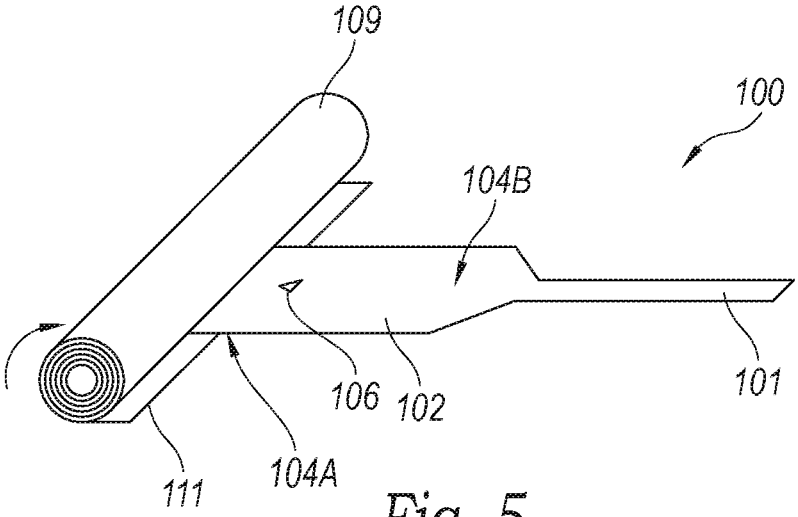

As shown in FIG. 5, after positioning the carrier 100 over the yoga mat 109, the yoga mat 109 can be rolled-up toward the edge 111. As the yoga mat 109 is rolled, the second end portion 103B (FIG. 4) of the planar portion 102 is rolled up with the yoga mat 109. Accordingly, rolling the carrier 100 up with the yoga mat 109 causes the overlapping portion of the carrier 100 to be sandwiched between adjacent layers of the rolled-up yoga mat 109. With this arrangement, both sides 104A and 104B of the overlapping portion can be in contact with the yoga mat 109, effectively doubling the area of contact between the carrier 100 and the yoga mat 109. Additionally, positioning the carrier 100 such that a tip of the alignment mark 106 points to and is aligned with the edge 111 of the yoga mat 109 can also help ensure that there is sufficient contact area between the carrier 100 and the yoga mat 109. Accordingly, positioning the carrier 100 over the yoga mat 109 as described in connection with FIGS. 4 and 5 can ensure that, when the yoga mat 109 and carrier 100 are rolled-up together, there is sufficient contact between the yoga mat 109 and the carrier 100, and that the yoga mat 109 cannot slip off the carrier 100. Further, positioning the carrier 100 such that the alignment mark 106 points to and is directly adjacent to the edge 111 of the yoga mat 109 ensures that the securing strap 105 (see FIG. 6 below) does not overlap with the yoga mat 109. Because of this arrangement, rolling up the carrier 100 with the yoga mat 109 will not cause the securing strap 105 (FIG. 6) to be obscured by the yoga mat 109, allowing the securing strap to be used to help secure the carrier 100 to the yoga mat 109.

Figure 6:
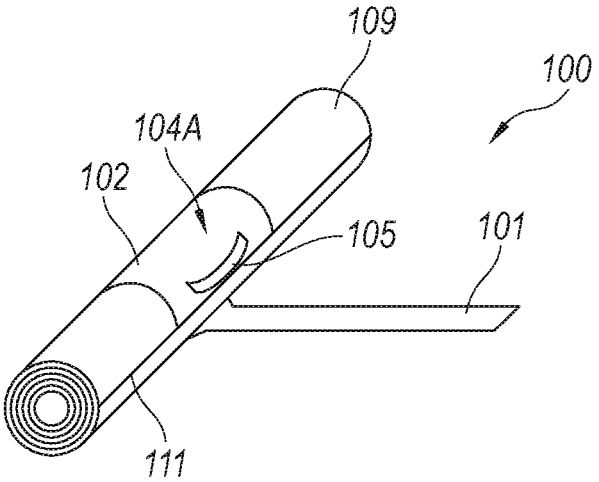
Figure 7:
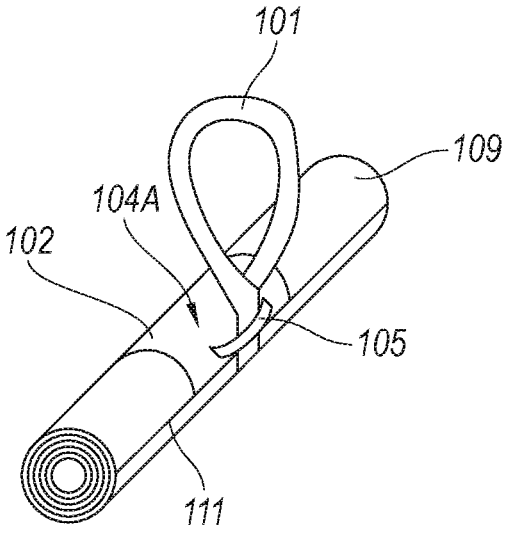

Continuing to roll up the yoga mat 109 causes the planar portion 102 of the carrier 100 to wrap around the yoga mat 109. For example, as shown in FIG. 6, the planar portion 102 can extend completely around the exterior of yoga mat 109 such that the second side 104B (FIG. 5) of the planar portion 102 faces toward and is in contact with the yoga mat 109 while the first side 104A faces away from the yoga mat 109. At this point, as shown in FIG. 7, the shoulder strap portion 101 can be admitted/pass through the securing strap 105 to secure the carrier 100 to the yoga mat 109. The shoulder strap portion 101 can then be used by a person to easily and securely carry the yoga mat 109.

Figure 8:
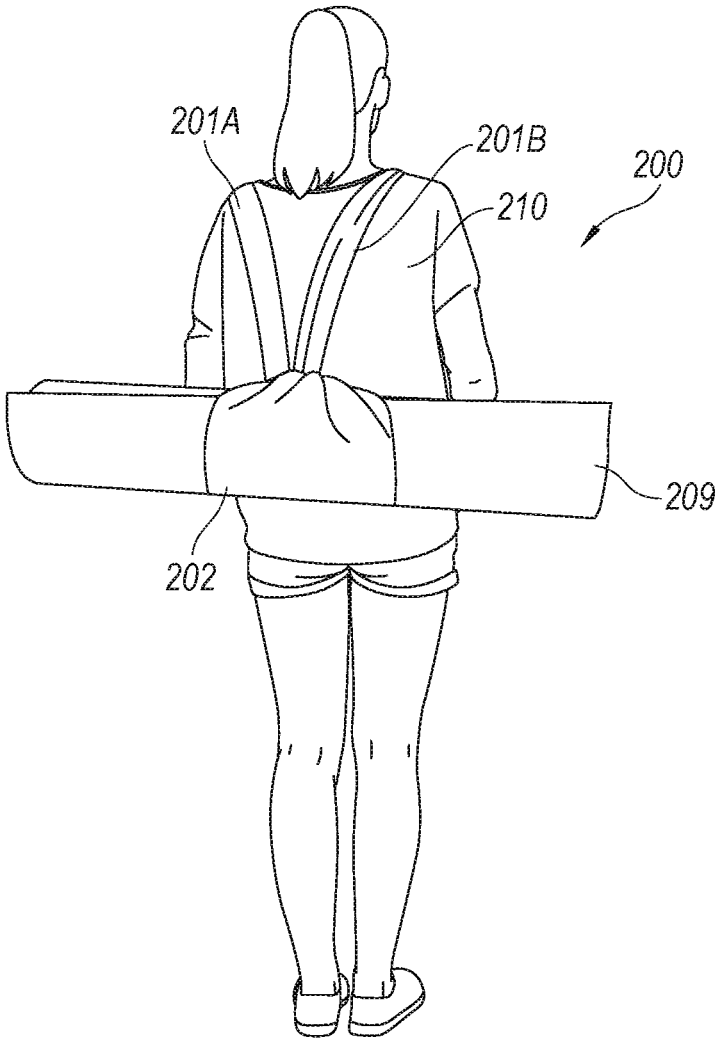
FIG. 8 is an isometric view of a person carrying a yoga mat using a yoga mat carrier having two shoulder straps and configured in accordance with embodiments of the present technology.
Figure 9:
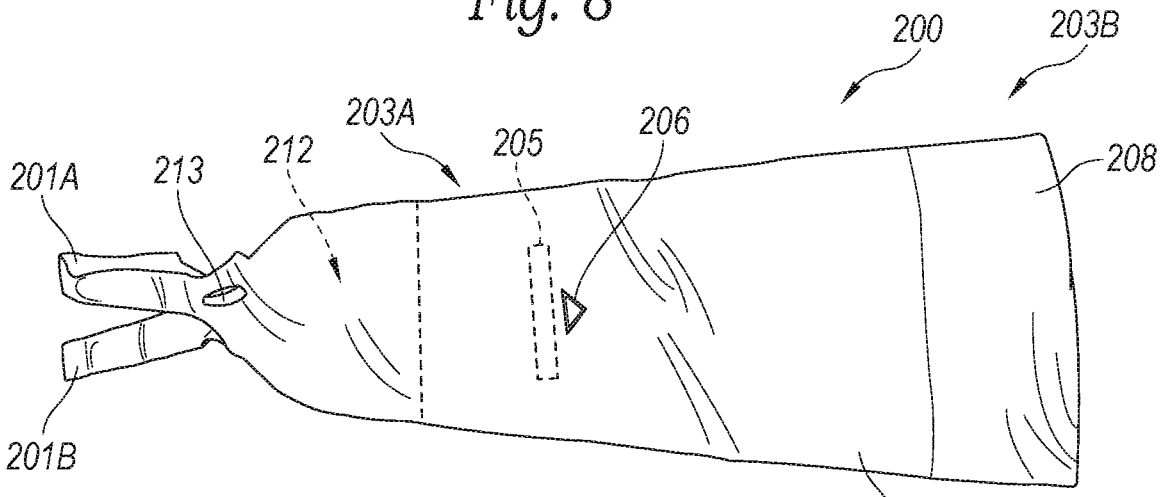
FIG. 9 is a plan view of the yoga mat carrier shown in FIG. 8.

In the illustrated embodiment, the carrier 100 includes a single shoulder strap portion 101 configured to be slung around one shoulder of a user. However, this is just one example. In other embodiments, the carrier 100 can include a second shoulder strap portion that enables the carrier to be used in a backpack configuration. FIG. 8, for example, is an isometric view of a person 210 using a carrier 200 having first and second shoulder straps 201A and 201B (collectively referred to as "shoulder straps 201") to carry a yoga mat 209, and FIG. 9 is a plan view of the carrier 200. The first and second shoulder straps 201A and 201B can be slung over the shoulders of the person 210 and the carrier 200 can hold the yoga mat 209 in a generally horizontal orientation relative to a local surface (e.g., the floor or ground on which the person 210 is standing or walking). The carrier 200 includes a planar portion 202 having first and second end portions 203A and 203B, an alignment mark 206, and a securing strap 205. A pocket 208 can be used to store the carrier 200 when not in use. Further, the carrier 200 can also include an internal pocket 212 coupled to the first end portion 203A that can be used to store at least one of the shoulder straps (e.g., the first shoulder strap 201A). In this way, if it is desired by the person 210 to only use one of the shoulder straps 201 (e.g., the second shoulder strap 201B), the first shoulder strap 201A can be stored within the internal pocket 212 so that it is out of the way. A pull-strap 213 coupled to the first shoulder strap 201A can be used to help remove the first shoulder strap 201A from the internal pocket 212.

Figure 10A:
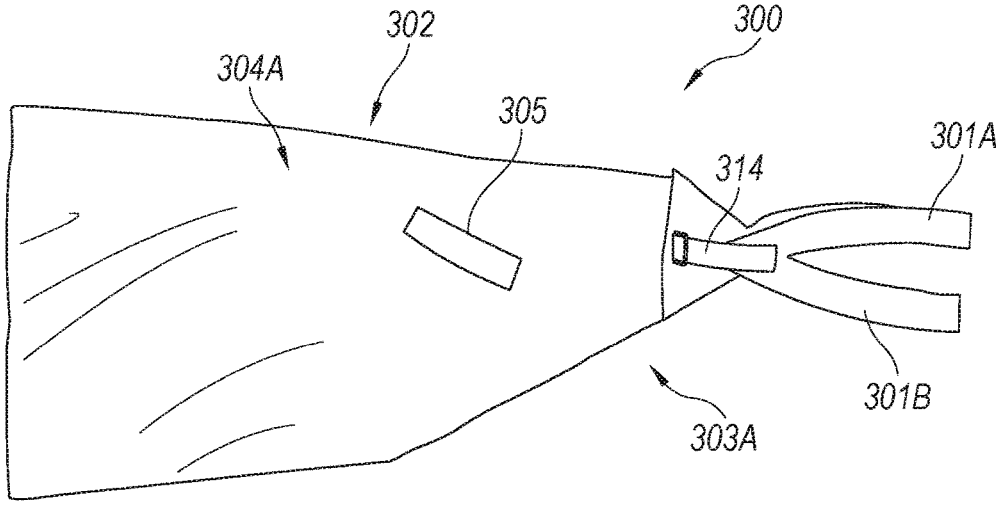
FIGS. 10A and 10B are plan views of a yoga mat carrier configured to carry a yoga mat in a vertical orientation in accordance with embodiments of the present technology.
Figure 10B:
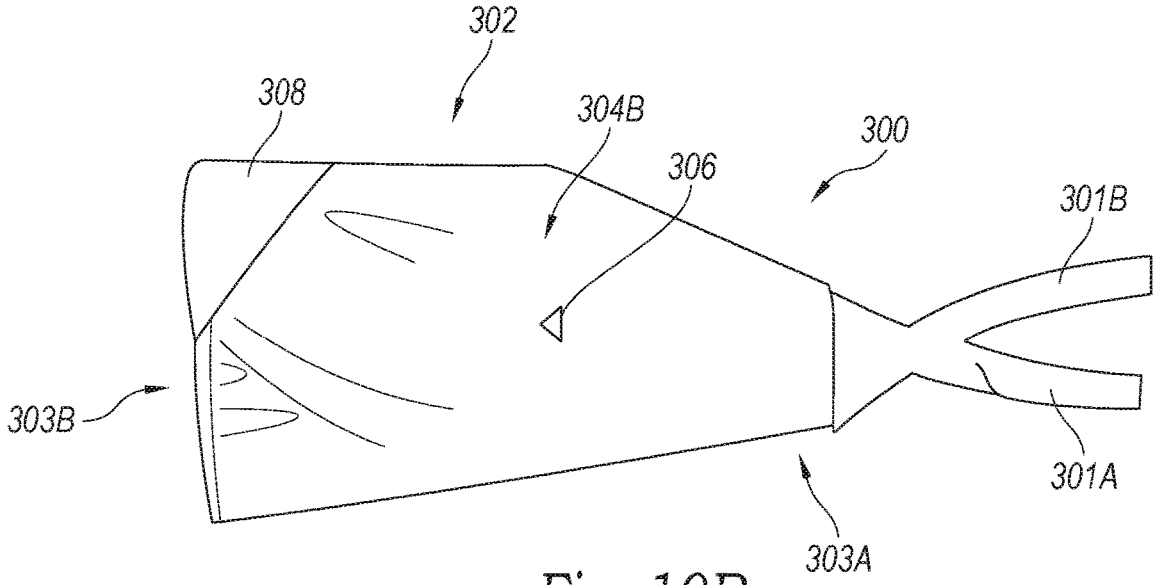
Figure 11A:
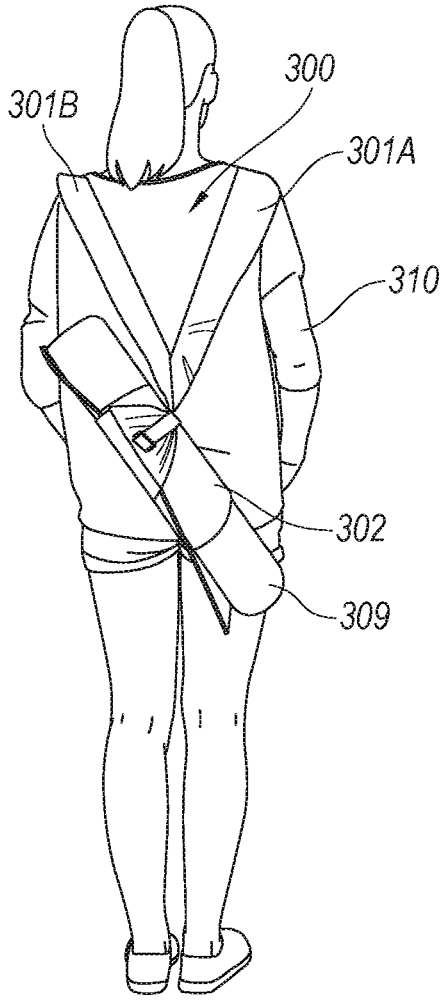
FIGS. 11A and 11B are isometric views of a person carrying a yoga mat using the carrier shown in FIGS. 10A and 10B.
Figure 11B:
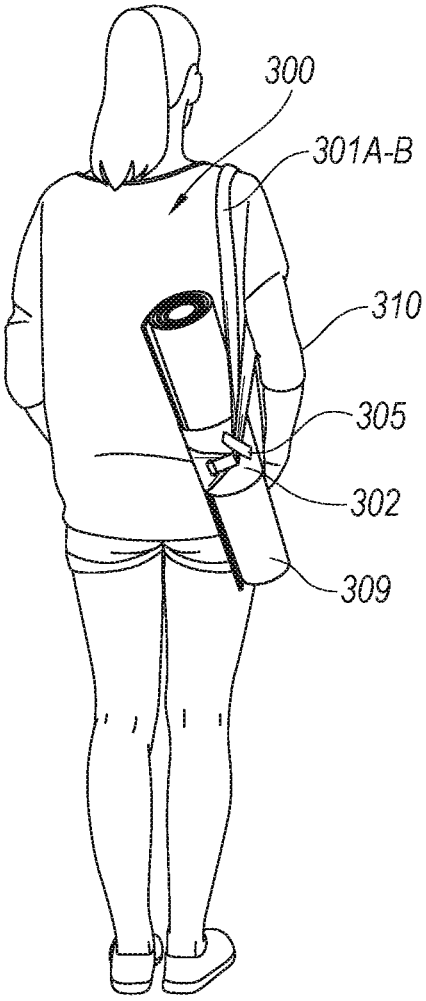

In the embodiments described above with reference to FIGS. 1-9, the disclosed carriers are configured to hold a yoga mat in a generally horizontal orientation. In other embodiments, however, carriers configured in accordance with the present technology may be configured to carry a yoga mat in a generally vertical orientation relative to a local surface. FIGS. 10A and 10B, for example, are plan views of a carrier 300 configured to carry a yoga mat vertically and FIGS. 11A and 11B are isometric views of a person 310 using the carrier 300 to carry a yoga mat 309. The generally vertical orientation can be modestly angled such that the yoga mat 309 extends from one side of the body of the person 310 to the other side, as illustrated in FIG. 11A. The carrier 300 can also be slung over a single shoulder of the user to carry the yoga mat 309 in a generally vertical orientation (as best seen in FIG. 11B).

The carrier 300 includes a planar portion 302 and first and second shoulder strap portions 301A and 301B. The shoulder strap portions 301A and 301B can be coupled to an adjustment strap 314 that can be used to adjust the length of the shoulder strap portions 301A and 301B. The planar portion 302 includes a securing strap 305 coupled to a first side 304A of the planar portion 302 and an alignment mark 306 coupled to a second side 304B of the planar portion 302. The alignment mark 306 is positioned to help align the carrier 300 with the yoga mat 309, and the securing strap 305 can be used to help secure the carrier 300 to the yoga mat 309.

In the embodiments shown in FIGS. 1-9, the securing straps 105 and 205 are generally parallel to the end portions 103B and 203B. In this way, when the shoulder strap portions 101 and 201 pass through the securing straps 105 and 205, the shoulder strap portions 101 and 201 are generally perpendicular to the securing straps 105 and 205, which causes the yoga mats 109 and 209 to hang generally horizontally. In contrast, as shown in FIG. 10A, the securing strap 305 of carrier 300 is angled with respect to the end portion 303B of the planar portion 302 such that, when the carrier 300 is secured to the yoga mat 309 and the shoulder strap portions 301A and 301B pass through the securing strap 305, the shoulder strap portions 301A and 301B are angled relative to the securing strap 305. Accordingly, when person 310 uses carrier 300 to carry the yoga mat 309 and puts shoulder strap portions 301A and 301B around her/his shoulders, the angled securing strap 305 causes the yoga mat 309 to hang generally vertically.

Figure 12:
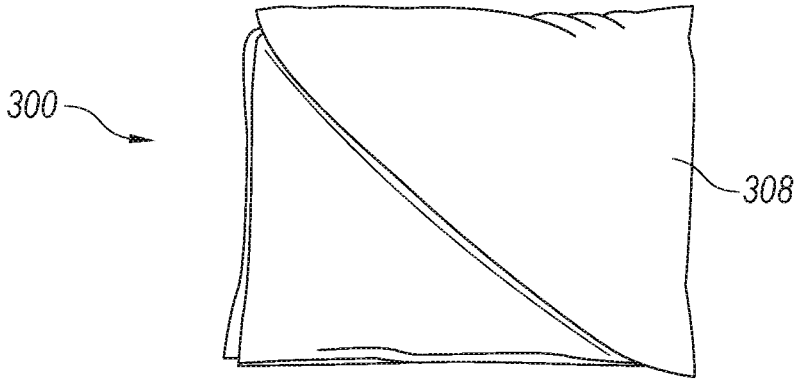
FIG. 12 is a plan view of the yoga mat carrier shown in FIGS. 10A and 10B in a folded configuration.

The carrier 300 also includes a pocket 308 for storing the carrier 300 when the carrier 300 is not in use. The pocket 308 is formed in the corner of the second end portion 303B and has a generally triangular shape. However, as shown in FIG. 12, when the carrier 300 is stuffed into the pocket 308, a portion of the carrier 300 can stick out of the pocket 308 such that the carrier 300 has a generally rectangular shape.

Figure 13A:
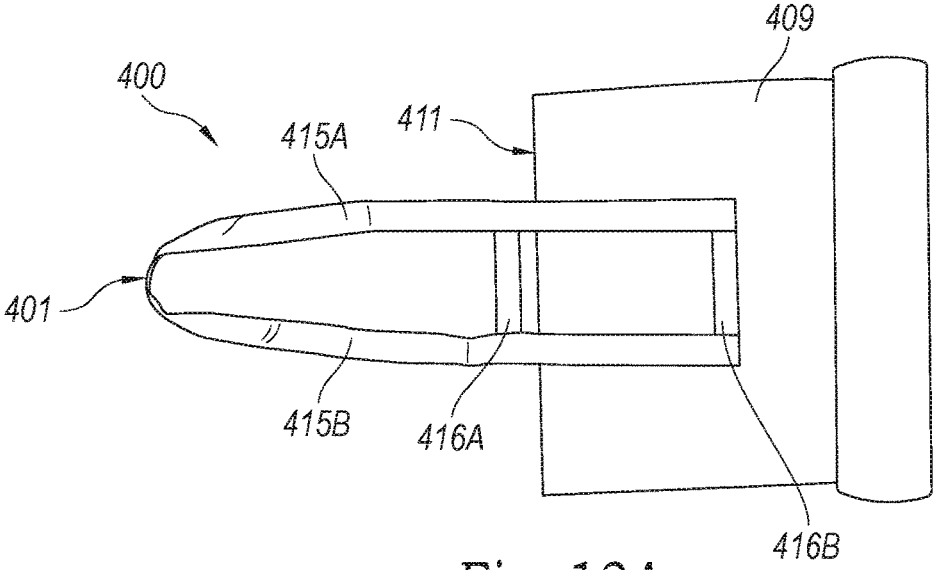
FIGS. 13A-13C are plan views of a yoga mat carrier formed from webbing and configured in accordance with another embodiment of the present technology.
Figure 13B:
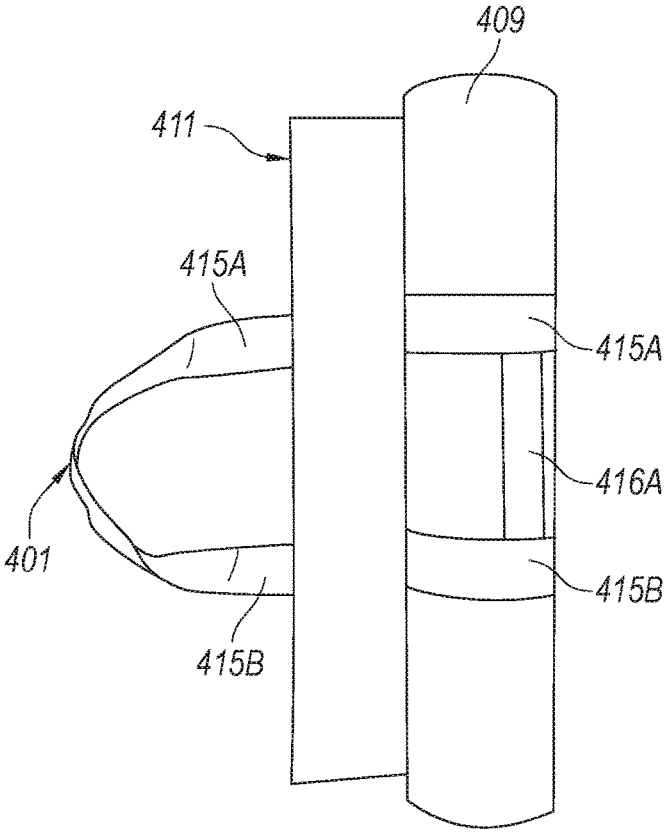
Figure 13C:
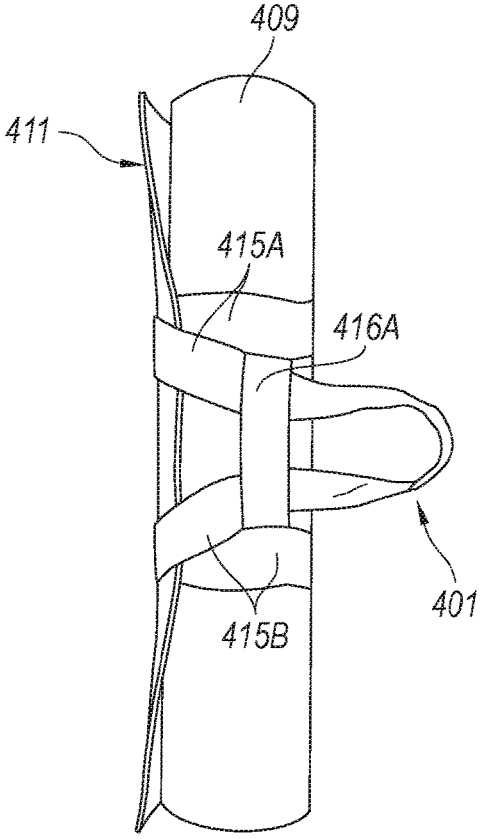

In the previously illustrated embodiments, the carriers include one or more sheets of a fabric material. In other embodiments, however, the carrier can be formed a different material. For example, FIGS. 13A-13C are plan views of a carrier 400 formed from webbing and used to carry a yoga mat 409. The carrier 400 includes first and second straps 415A and 415B of webbing coupled together at one end to form a handle portion 401. The carrier 400 also includes first and second cross strap portions 416A and 416B coupled between the straps 415A and 415B to provide support and structure to the carrier 400. In some embodiments, the straps 415A and 415B can be formed from two different pieces of webbing attached together to form the handle portion 401. In other embodiments, the straps 415A and 415B can be formed from a single, continuous piece of webbing.

To couple the carrier 400 to the yoga mat 409, the carrier 400 can be positioned such that the second cross strap portion 416B overlaps with the yoga mat 409 while the first cross strap portion 416A does not overlap with the yoga mat 409 and is adjacent to an edge 411 of the yoga mat 409. In this way, rolling the yoga mat 409 up causes the second cross strap portion 416B to be sandwiched between adjacent layers of the rolled-up yoga mat 409 while the first cross strap portion 416A remains exposed. Continuing to roll-up the yoga mat 409 and the carrier 400 causes the straps 415A and 415B to wrap around the yoga mat 409. At this point, the carrier 400 can be secured to the yoga mat 409 by pulling the handle portion 401 between the first cross strap portion 416A and the yoga mat 409, as shown in FIG. 13C. The handle portion 401 can then be used to carry the yoga mat 409.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. For example, while steps are presented in a given order, alternative embodiments may perform steps in a different order. Moreover, the various embodiments described herein may also be combined to provide further embodiments. Additionally, although many of the embodiments are described with respect to a carrier for a yoga mat, it should be noted that other applications and embodiments in addition to those disclosed herein are within the scope of the present technology. For example, the disclosed carrier can be used to carry other flexible and planar objects such as towels, rugs, blankets, etc. Further, the disclosed carrier can also be used in an industrial setting to carry large rolls of materials, including textiles and paper. In some embodiments, the disclosed carrier can also be used to carry architectural drawings or artwork.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The invention claimed is:

1. A carrier for securely carrying a yoga mat, the carrier comprising:

a shoulder strap portion; and a planar portion having a first end portion and a second end portion opposite the first end portion, wherein the first end portion is coupled to the shoulder strap portion, the planar portion comprising a first surface and a second surface opposite the first surface; and a securing strap coupled to the first surface, wherein the securing strap is positioned near a midpoint of the planar portion between the first end portion and the second end portion, wherein the first surface at the second end portion is positionable to interface with the yoga mat before the planar portion is rolled up with the yoga mat, and the securing strap is sized and positioned to admit at least a part of the shoulder strap portion through the securing strap after the planar portion is rolled up with the yoga mat.

2. The carrier of claim 1 wherein the planar portion further comprises an alignment mark on the second surface, and wherein the alignment mark is positioned near a midpoint of the planar portion between the first end portion and the second end portion.

3. The carrier of claim 2 wherein the alignment mark is positioned to be aligned with an edge of the yoga mat when the first surface at the second end portion interfaces with the yoga mat.

4. The carrier of claim 1 wherein the planar portion is positioned to wrap around the yoga mat when the planar portion is rolled up with the yoga mat.

5. The carrier of claim 1 wherein the carrier, when slung over a shoulder of a user, is configured to securely carry the yoga mat in a generally horizontal orientation relative to a local surface.

6. The carrier of claim 1 wherein the carrier, when slung over a shoulder of a user, is configured to securely carry the yoga mat in a generally vertical orientation relative to a local surface.

7. The carrier of claim 1 wherein the planar portion further comprises a pocket attached to the second end portion, and wherein the carrier is configured to be stuffed into the pocket after being decoupled from the yoga mat.

8. The carrier of claim 1 wherein the planar portion is composed of nylon.

9. The carrier of claim 1 wherein the shoulder strap portion comprises a first shoulder strap portion, and wherein the carrier further comprises a second shoulder strap portion coupled to the first end portion.

10. A method of using a carrier to securely carry a yoga mat, wherein the carrier includes a shoulder strap portion coupled to a planar portion, and wherein the planar portion includes an end portion that opposes the shoulder strap portion, a first surface and a second surface opposite the first surface, and a securing strap formed on the first surface, the method comprising:

positioning the carrier on the yoga mat such that the first surface faces toward the yoga mat and the securing strap does not overlap with an edge of the yoga mat;

rolling the yoga mat up toward the carrier until the end portion is entirely covered by the yoga mat; and pulling the shoulder strap through the securing strap to secure the carrier to the yoga mat.

11. The method of claim 10 wherein the carrier includes an alignment mark formed on the second surface and wherein positioning the carrier on the yoga mat comprises positioning the carrier such that the alignment mark overlaps with or is adjacent to the edge of the yoga mat.

12. The method of claim 11 wherein the alignment mark is positioned closer to the end portion than the securing strap.

13. The method of claim 10 wherein rolling the yoga mat up comprises rolling the yoga mat toward the edge of the yoga mat.

14. The method of claim 10 wherein rolling the yoga mat up comprises rolling the yoga mat until the planar portion wraps around an exterior of the rolled-up yoga mat.

15. A carrier configured to securely carry a flexible planar object, the carrier comprising:

a strap portion; and a planar portion coupled to the strap portion, wherein the planar portion comprises an end portion that opposes the strap portion;

a first surface and a second surface opposite the first surface; and a securing band engaged with the first surface, wherein the planar portion includes an alignment mark on the second surface positioned such that the alignment mark is adjacent to an edge of the planar object when the first surface is in contact with the planar object before the planar object is rolled up, and wherein the securing band is positioned to admit the strap portion through the securing band after the flexible planar object is rolled up with the planar portion.

16. The carrier of claim 15 wherein the planar portion comprises a first end and a second end opposite the first end, and wherein the securing band is positioned at approximately a midpoint of the planar portion between the first and second ends.

17. The carrier of claim 15 wherein the first surface is in contact with the flexible planar object while the second surface is not before the planar object is rolled up.

18. The carrier of claim 17 wherein both the first and second surfaces of the planar portion are in contact with the flexible planar object after the planar object and the planar portion are rolled up together.

* * * * *